United States Patent [19]

Rebsamen et al.

[11] 4,003,510

[45] Jan. 18, 1977

[54] PROCESS AND APPARATUS FOR EXTENDING THE LIFE OF THE BELT OF A DELIVERY DEVICE FOR TEXTILE FILAMENTS

[75] Inventors: Albert Rebsamen, Wilen; Franz Xaver Scherrer, Lichtensteig, both of Switzerland

[73] Assignee: Heberlein & Co. AG, Wattwil, Switzerland

[22] Filed: July 24, 1975

[21] Appl. No.: 598,817

[30] Foreign Application Priority Data

Aug. 28, 1974 Switzerland ..... 11703/74

[52] U.S. Cl. ..... 226/1; 226/170; 226/199; 226/200; 242/18.1; 242/43 R

[51] Int. Cl.[2] ..... B65H 51/14; B65H 54/32

[58] Field of Search ..... 242/18.1, 43 R, 157.1, 242/158 B, 158.1; 226/199, 200, 170, 1, 19

[56] References Cited

UNITED STATES PATENTS 2,787,368 4/1957 Clark et al. ..... 226/200 X

FOREIGN PATENTS OR APPLICATIONS 612 11/1903 United Kingdom ..... 242/18.1

*Primary Examiner*—Johnny D. Cherry
*Assistant Examiner*—Bruce H. Stoner, Jr.
*Attorney, Agent, or Firm*—Larson, Taylor and Hinds

[57] ABSTRACT

The wear due to the filaments on a circulating delivery belt having a surface for receiving thereon a stream of textile filaments and conveying them, for example in a false-twist texturing machine, is reduced by feeding the filaments, just prior to reaching the belt, through a thread-guide that has a reciprocating motion transverse to the filaments imparted thereto which is the resultant of two uniform components of reciprocation of different periods, so that the position of the filaments across the belt is varied in non-uniform cycles repeated in groups thereof. The thread-guide is carried by a rod in which is mounted a journal having eccentric pins at its opposite ends. A basic component of reciprocation is imparted to the rod by a track rotating eccentrically about a fixed axis and acting on one of the two pins to cause the journal and rod to reciprocate along the rod axis. An additional component is imparted by causing the journal to rotate about the eccentric pin axis by means of a gear on the other one of the two pins, this gear being in mesh with a second gear fixed to a third and parallel pin mounted for its axis to revolve round the fixed axis of the eccentric track. Preferably the belt circulates with a period different from the period of the basic component of reciprocation.

7 Claims, 3 Drawing Figures

PROCESS AND APPARATUS FOR EXTENDING THE LIFE OF THE BELT OF A DELIVERY DEVICE FOR TEXTILE FILAMENTS

FIELD OF THE INVENTION

The present invention to a mechanism and a process for extending the life duration of a belt in a delivery device for textile filaments.

So-called belt delivery devices which are widely known in textile industry serve to carry along filaments or yarns and consist of a drivable roller against which a belt passing around two rollers supported by a swivelling arm is passed by means of a tension spring fixed on the swivelling arm. When using such a belt delivery devices in machines for treating synthetic yarns, for example in false-twist texturing machines, the belts are subject to high wear since the filament always passes over the same portion of the belt. This wear is all the higher if filament bundles of synthetic material, having individual filaments with sharp edges are used.

DESCRIPTION OF THE PRIOR ART

It has already been attempted to reduce wear of the belt by means of a movable thread-guide disposed near the device which feeds the filament to the delivery device, a stroke extending over the width of the belt being imparted to the thread-guide. Thereby, it is assured that the filament passes over the belt in two periodically alternating positions. It has however been found that this does not provide any essential extension of the life duration of the belts.

SUMMARY OF THE INVENTION

It is the purpose of the present invention to provide means by which the position of the filament on the belt is continuously varied so that uniform wear of the whole surface of the belt and thereby an essentially extended duration of life of the belt is achieved.

This purpose is achieved by superposing on the stroke of the thread-guide an additional stroke so that the reversal points of the thread-guide come to lie at different locations distributed over the whole width of the stroke during a plurality of basic stroke periods. The period of the additional stroke may correspond to *n* times the basic stroke, n being a fraction greater than 2. The numerator and/or the denominator of the fraction may be a prime number or prime numbers between 11 and 113 inclusive. The time for one revolution of the belt of the delivery device may be different from the time for one basic stroke.

DESCRIPTION OF THE DRAWINGS

An example of the present invention will be explained hereinafter in more detail with reference to the attached drawings wherein:

Referring to FIGS. 1 and 2, a rod 1 is movable transversely with respect to the direction of movement of a filament or yarn passing to a delivery belt 4. On one end of the rod 1 there is disposed a thread-guide 2 for modifying the position of the yarn 19 on the circulating belt 4 which extends around rollers 3, 3'. The thread-guide rod 1 is supported by bearings 5, 5' and its other end is provided with an enlarged portion 6 in which there are arranged two ball bearings 7, 7' which support a journal 8. On the front faces of journal 8, there are arranged coaxial eccentric pins 9, 9'. A circular disc 10 is rigidly fixed on a rotatably supported shaft 11 and is driven by a driving shaft 17 in frictional contact therewith. The circular disc 10 has on its upper face an eccentrically arranged circular cam groove 12 in which a ball bearing 13 is arranged. Bearing 13 supports the eccentric pin 9'. At the front face of the upper end of shaft 11, there is disposed an eccentric pin 14 which supports pinion 15 and is rigidly connected therewith. The pinion 15 meshes with a further pinion 16 which is fitted to eccentric pin 9 and is rigidly connected therewith.

Figure 1:
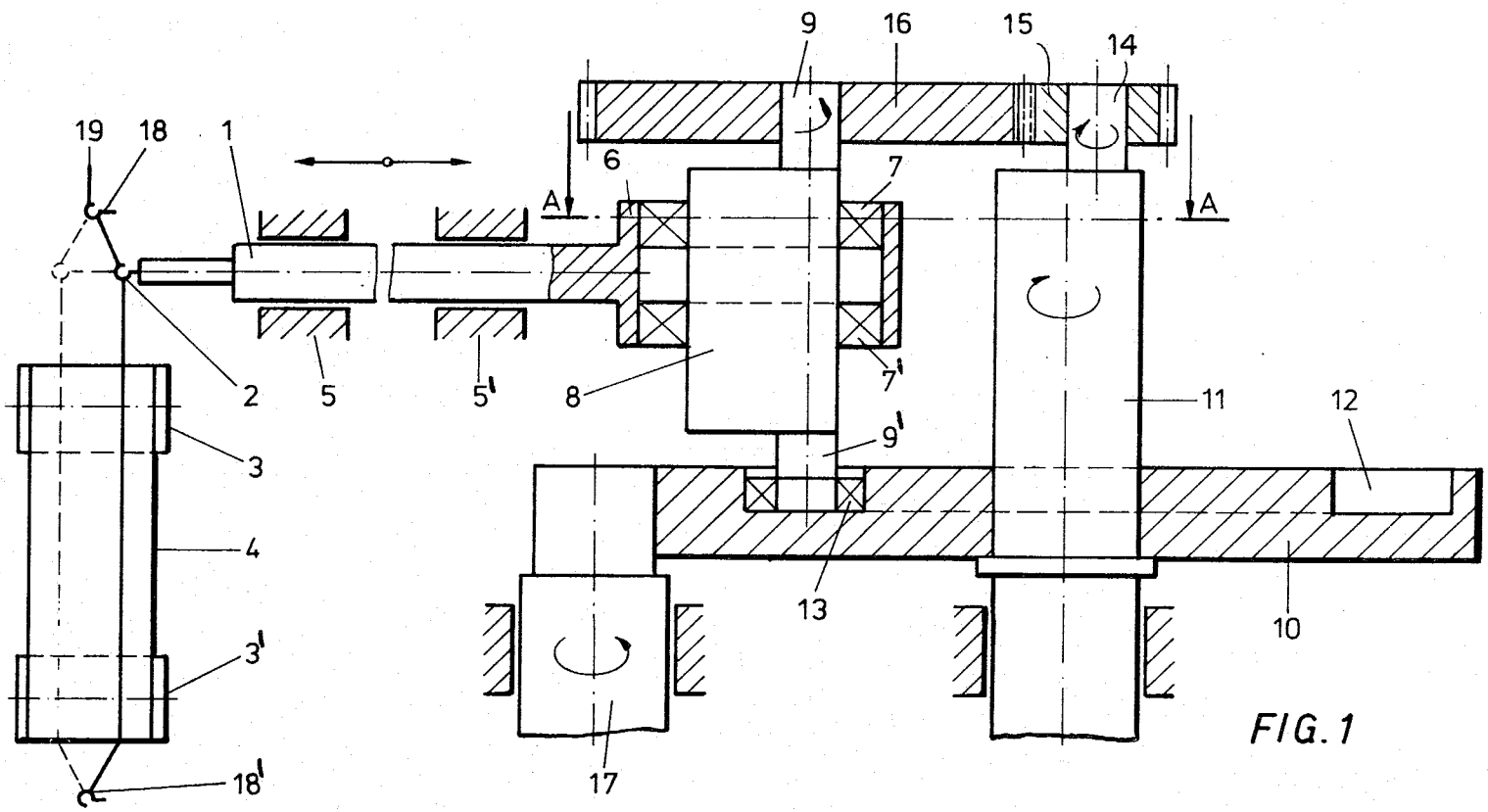
FIG. 1 is a front elevation of mechanism for moving a thread guide through which a filament passes to a belt, the mechanism being partially in central longitudinal section.
Figure 2:
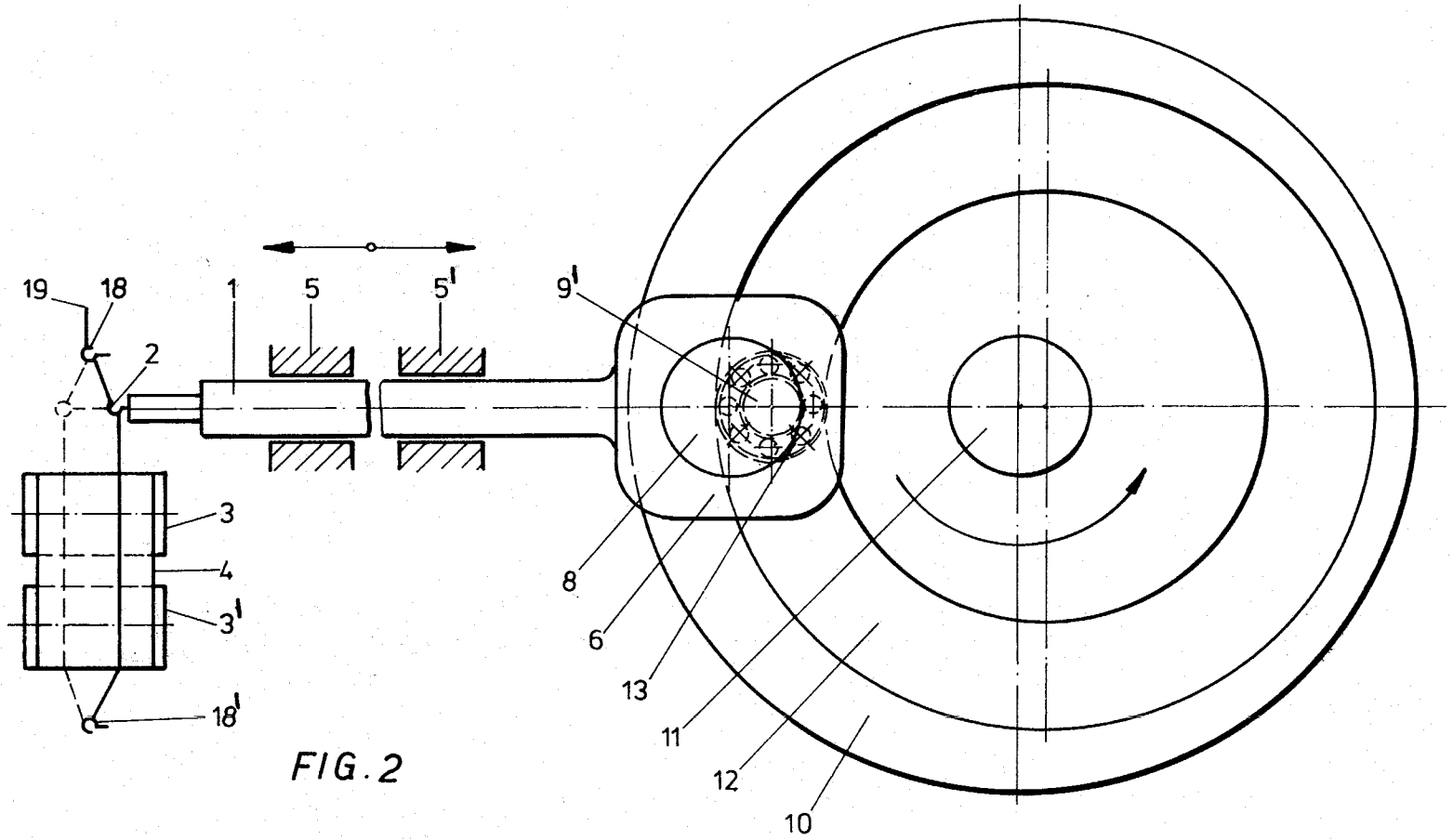
FIG. 2 is a cross-section along A—A of FIG. 1.
Figure 3:
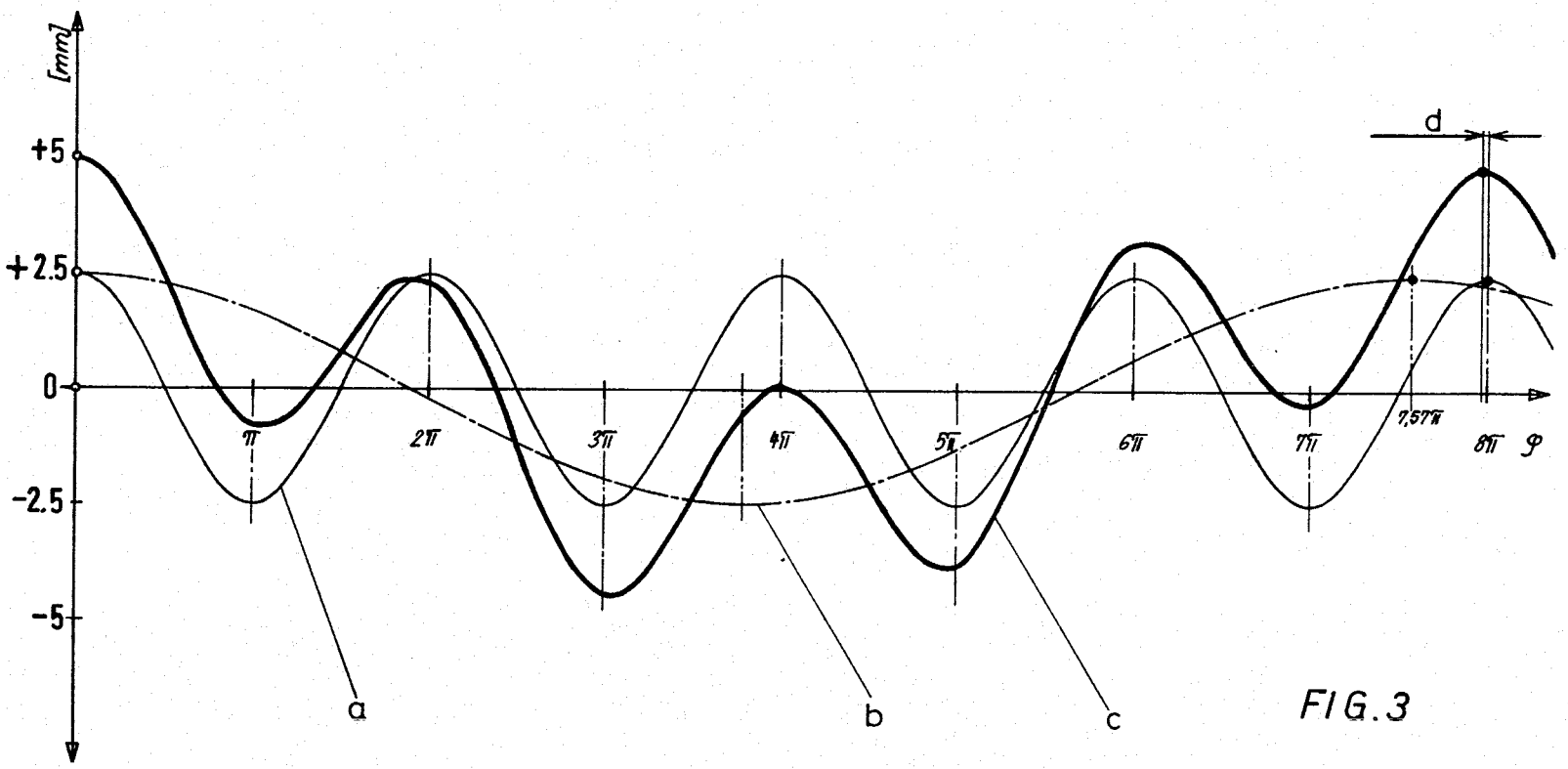
FIG. 3 is a diagram showing the movement of the thread-guide.

The yarn 19 is fed through stationary thread-guide 18, then consecutively passes through thread-guide 2, over belt 4 and through a further stationary thread-guide 18'. By means of the driven circular disc 12 and of the eccentric pin 9', a basic stroke or component of reciprocation is imparted to rod 1 with the thread-guide 2. This produces a periodic sinusoidal modification of the position of thread-guide 2. A superposed stroke or component of reciprocation is produced by the gearing consisting of eccentric pin 14, pinions 15, 16 and eccentric pins 9, 9'. The number of teeth on at least one of pinions 15, 16 may be a prime number or a multiple thereof, or the numbers of teeth on both pinions may be unequal prime numbers of more than 7 or a multiple thereof. The number of teeth on pinion 15 may for example be 23 and the number of teeth on pinion 16 may be 87 (i.e. $3 \times 29$). This results in a ratio between the basic stroke and the superposed stroke of 1 : 3.78 as shown in the diagram of FIG. 3. In this diagram, the movement of threadguide 2 over four revolutions of circular disc 10 is shown. Curve *a* shows the component of reciprocating movement due to basic stroke which is 5 mm, and curve *b* shows the component due to the superposed stroke which is also 5mm.

Curve *c* shows the resultant of the two reciprocations; it will be seen that, during the four revolutions of circular disc 10, the reversal points of thread-guide 2 are in different positions distributed over the whole of the resultant reciprocation. As furthermore shown in FIG. 3, the duration of the period of the resultant due to the four revolutions of disc 10 differs from the period of the four-fold basic reciprocation *a* by the amount of $d = 0.003\ \pi$. Since, furthermore, the revolution time of the belt 4 around rollers 3, 3' depends on the duration of the basic stroke *a*, an additional modification of the yarn application on the surface of the belt is achieved. The cyclic period of the additional component of reciprocation *b* should preferably be n times the cyclic period of the basic component of reciprocation *a*, *n* being a fractional number and greater than 2. The numerator an denominator of the fractional number are preferably prime numbers between 11 and 113 inclusive.

The system of the present invention makes possible a very uniform wear of the belt 4 and, when processing textile filament bundles consisting of synthetic material having individual filaments with sharp edges, the duration of the belt life is extended by at least six times.

We claim:

1. Delivery mechanism for textile filaments comprising a delivery belt having a surface for receiving thereon a stream of textile filaments and carrying said filaments longitudinally of said belt, a thread-guide for guiding said filaments immediately prior to reaching said surface, a rod mounted to reciprocate transversely to said stream of textile filaments, said thread-guide being mounted at one end of said rod, a journal bearing mounted at the opposite end of said rod with the axis of said journal bearing perpendicular to said rod, a journal mounted in said journal bearing and passing therethrough, two coaxial pins fixed at opposite ends of said journal on an axis eccentric with respect to said first-mentioned axis, a shaft mounted to rotate about a fixed axis parallel to said first and a second mentioned axes, a member fixed to said shaft and formed with a circular cam track surrounding said shaft and eccentric with respect to said fixed axis, said track being positioned to receive a first one of said two pins and impart reciprocating movement thereto on rotation of said shaft, a third pin, said third pin being fixed to said shaft, parallel to the second one of said two pins on an axis parallel to and eccentric with respect to said fixed axis, and two gears in mutual engagement respectively fixed on said second and third pins whereby rotation of said shaft imparts rotation to said journal to impart an additional component of reciprocation to said thread-guide while said cam track imparts a basic component of reciprocation to said thread-guide.

2. Delivery mechanism according to claim 1, wherein said additional component of reciprocation has a cyclic period which is $n$ times the cyclic period of said basic component of reciprocation, $n$ being a fractional number and higher than 2.

3. Delivery mechanism according to claim 2, wherein the numerator and denominator of said fractional number are prime numbers between 11 and 113 inclusive.

4. Delivery mechanism according to claim 1, wherein said cam track is a circular groove and wherein said mechanism comprises a ball bearing surrounding said first one of said two pins and formed to follow said cam track.

5. Delivery mechanism according to claim 1, wherein at least one of said gears has a number of gear teeth, said number being pn where p is a prime number and $n$ any convenient whole number.

6. Delivery mechanism according to claim 1 wherein said gears have unequal numbers of teeth, said numbers being unequal prime nubers higher than $7n$, where $n$ is any convenient whole number.

7. A process for extending the life duration of a circulating delivery belt having a surface for receiving thereon a stream of textile filaments and carrying said filaments longitudinally of said belt, said process comprising imparting to said stream immediately, prior to reaching said belt, to-and- fro transverse movements having a basic uniform component of reciprocation and an additional uniform component of reciprocation superposed on said basic component so that the points of reversal of said to-and-fro movement are distributed across said belt, the number of said points of reversal being greater than would be available from either of said components alone, said process further comprising imparting to said belt a period of circulation which is different from the period of said basic component of reciprocation.

* * * * *